United States Patent [19]

Bonner et al.

[11] Patent Number: 4,749,333

[45] Date of Patent: Jun. 7, 1988

[54] VANE PLATFORM SEALING AND RETENTION MEANS

[75] Inventors: George A. Bonner; James E. Fisher, both of Palm Beach Gardens, Fla.

[73] Assignee: The United States of America as represented by the Secretary of the Air Force, Washington, D.C.

[21] Appl. No.: 861,905

[22] Filed: May 12, 1986

[51] Int. Cl.[4] ..... F04D 29/08

[52] U.S. Cl. ..... 415/189; 415/217; 277/235 A

[58] Field of Search ..... 415/139, 136, 138, 174, 415/170 R, 189–191, 217, 218; 60/39.75; 277/233, 234, 235 R, 235 A, 236, 199

[56] References Cited

U.S. PATENT DOCUMENTS

| | | | |
|---|---|---|---|
| 2,809,130 | 10/1957 | Rappaport | 277/235 A X |
| 3,542,483 | 11/1970 | Gagliardi | 415/136 |
| 3,728,041 | 4/1973 | Bertelson | 415/189 |
| 3,785,856 | 1/1974 | Gotoh | 277/235 A X |
| 3,801,220 | 4/1974 | Beckershoff | 415/217 X |
| 3,892,497 | 7/1975 | Gunderlock et al. | 415/134 |
| 3,938,906 | 2/1976 | Michel et al. | 415/139 |
| 3,970,318 | 7/1976 | Tuley | 277/26 |
| 3,986,789 | 10/1976 | Pask | 415/178 |
| 4,524,980 | 6/1985 | Lillibridge | 415/191 |

FOREIGN PATENT DOCUMENTS

| | | | |
|---|---|---|---|
| 1553701 | 10/1979 | United Kingdom | 415/191 |

*Primary Examiner*—Robert E. Garrett
*Assistant Examiner*—Joseph M. Pitko
*Attorney, Agent, or Firm*—Donald J. Singer; William G. Auton

[57] ABSTRACT

An improved vane platform feather seal is disclosed for use in turbine engines. This feather seal contains a flat, thin feather seal, which is attached by adhesive to ease assembly to an L-shaped retainer plate to result in a combined thickness of 0.032 inches. This new seal may be used to replace the inner vane platform seals which are currently used in F-100 turbine engines, which have a history of not bending easily to conform to seal slots. The new seal provides improved platform sealing without loss of platform retention in the event of vane burn through.

4 Claims, 3 Drawing Sheets

VANE PLATFORM SEALING AND RETENTION MEANS

STATEMENT OF GOVERNMENT INTEREST

The invention described herein may be manufactured and used by or for the Government for governmental purposes without the payment of any royalty thereon.

CROSS-REFERENCE TO RELATED APPLICATIONS

The subject matter of this application is related to the subject matter contained in U.S. patent application Ser. No. 881,741, filed Jul. 3, 1986, entitled "ANTI ROTATION GUIDE VANE BUSHING".

BACKGROUND OF THE INVENTION

The present invention relates generally to turbine engines and more specifically to an improved turbine vane platform seal for use in an F-100 aircraft turbine engine.

Currently, the F-100 aircraft turbine engine has a turbine vane which uses a thick inner vane platform feather seal. One purpose of this seal is to provide for retention of the vane platform if both airfoils are burned through by a hot streak out of the combustor and seal the platform gaps against hot gas leakage. Although the existing system does provide some vane platform sealing, the use of the thick seal seriously compromises vane platform sealing. The thick seals do not bend easily to conform to the seal slots to produce a completely effective air seal. This sealing is necessary to prevent cooling air from entering into the second stage engine flow path.

The task of replacing the inner vane platform feather seal in the F-100 aircraft turbine engine is alleviated, to some degree, by the systems disclosed in the following U.S. Patents the disclosures of which are incorporated herein by reference:

U.S. Pat. No. 3,728,071 issued to Bertelson;

U.S. Pat. No. 3,542,483 issued to Gagliardi;

U.S. Pat. No. 3,970,318 issued to Tuley;

U.S. Pat. No. 3,986,789 issued to Pask;

U.S. Pat. No. 3,892,497 issued to Gunderlock et al; and

U.S. Pat. No. 3,938,906 issued to Michel et al.

All of the above-cited references relate generally to rotary kinetic fluid motors in pumps, including thermal expansion joint, resilient, stator vane in shroud ring opening and axial or circumferential expansion, and circumferential spaced nozzle or stator segments. The Michel et al patent discloses a slidable stator seal for use in a gas turbine assembly. The Pask patent discloses a stator structure for a gas turbine engine including a thin sealing strip. The Gagliardi patent discloses a turbine stator structure including a tongue arrangement.

One proposed solution entails a replacement of the thick seal used in the F-100 turbine engine with a thin seal. However, experience with this proposal indicated that thin seals alone do not provide enough strength to retain the platforms after vane burn-through.

In view of the foregoing discussion, it is apparent that there currently exists the need to provide a replacement to the turbine vane platform seals used in F-100 turbine engines. The present invention is intended to satisfy that need.

SUMMARY OF THE INVENTION

The present invention replaces the thick L-shaped vane platform feather seal in an F-100 turbine engine with a comparatively thin seal for good compliance to the vane slots and L-shaped retainer for increased platform retention in the event of vane airfoil burn through. The current thick seal had a thickness of 0.032 inches, which at times prohibited it from bending to conform to the seal slots. Experiences with thinner seals were unsatisfactory since they possessed insufficient strength to retain the vane platform in the event of a burn-through of the vane airfoils. The present invention uses an L-shaped retainer plate, of 0.020 inches in thickness, which is fixed by an adhesive (to ease assembly) to a thin feather seal of 0.10 inches in thickness. The combined thickness, including that of the adhesive is 0.032 inches, the same as that of the previous one-piece seal retainer.

It is an object of the present invention to provide an improved vane platform sealing means that easily conforms to the mechanical seal slots of the F-100 turbine engine.

It is another object of the present invention to provide for the retention of the vane platform of the F-100 turbine engine when both airfoils are burned through.

It is another object of this invention to permit easy assembly of the seal and L-shaped retainer. At operating temperature, the adhesive burns off and the thin seal is free to conform to the seal slot. The adhesive also prevents misassembly of the parts.

These objects together with other objects, features and advantages of the invention will become more readily apparent from the following detailed description when taken in conjunction with the accompanying drawings wherein like elements are given like reference numerals throughout.

DESCRIPTION OF THE DRAWINGS

FIG. 4 is an end view of the turbine vane assembly of the F-100 engine which depicts the L-shaped slot that the present invention will reside in.

DETAILED DESCRIPTION OF THE PREFERRED EMBODIMENT

The present invention is an improved turbine vane platform seal which may be used in the F-100 turbine engine.

Figure 1:
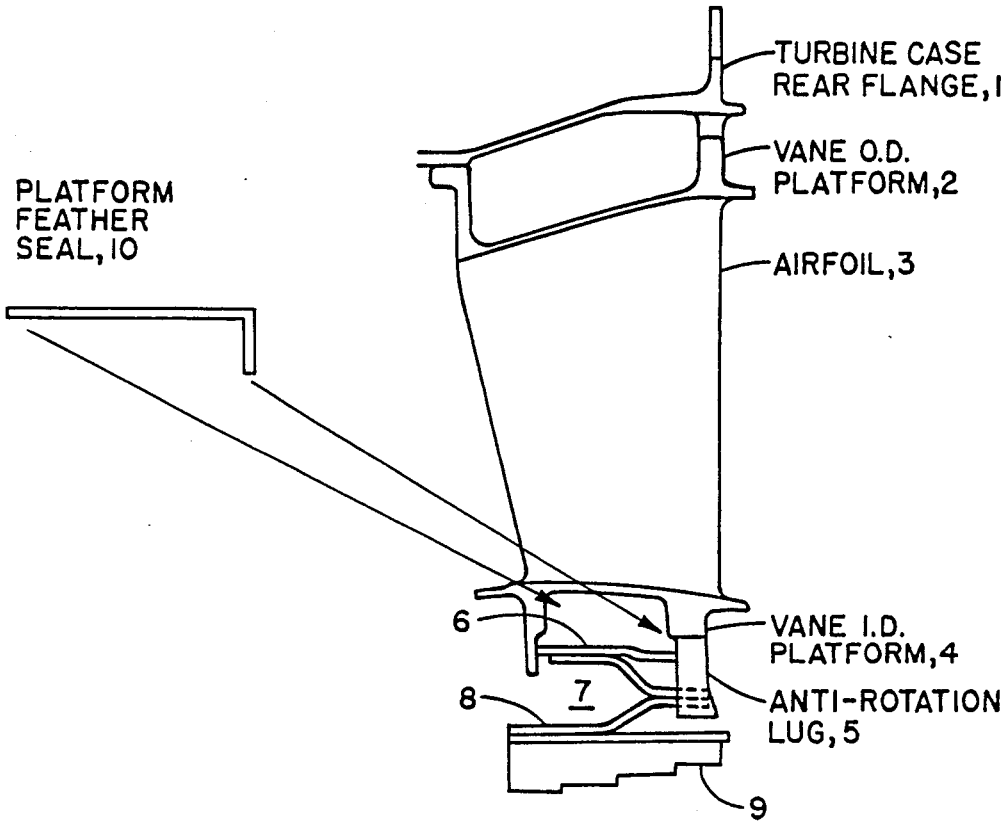
FIG. 1 PRIOR ART
FIG. 1 is a mechanical schematic of the current configuration of the turbine vane platform seal of the F-100 turbine engine.

The reader's attention is now directed towards FIG. 1, which is a mechanical schematic of the current configuration of the turbine vane platform seal in the F-100 turbine engine. All of the parts in FIG. 1 are nonrotating, and the vane airfoils are normally in pairs.

In the prior art configuration of FIG. 1, the platform feather seal 10 rests in an L-shaped slot on the vane platform 4, near anti-rotation lug 5, and the inner vane support assembly 6, 7, and 8. This prior art vane platform feather seal 10 has a thickness of 0.032 inches, and must be of sufficient strength to retain the vane platform 4 in the event of a burn-through of the vane airfoil 3. As mentioned above, the airfoils are normally in pairs. The platform feather seal rests in an L-shaped slot of first vane I.D. platform, and spans to a similar slot in an adjacent vane I.D. platform. In the event of a burn-through of an airfoil 3, the first vane I.D. platform is held in position next to the adjacent vane I.D. platform by the vane platform feather seal. As mentioned above, the use of thinner seals has been unsuccessful since they possess inadequate strength.

Figure 2:
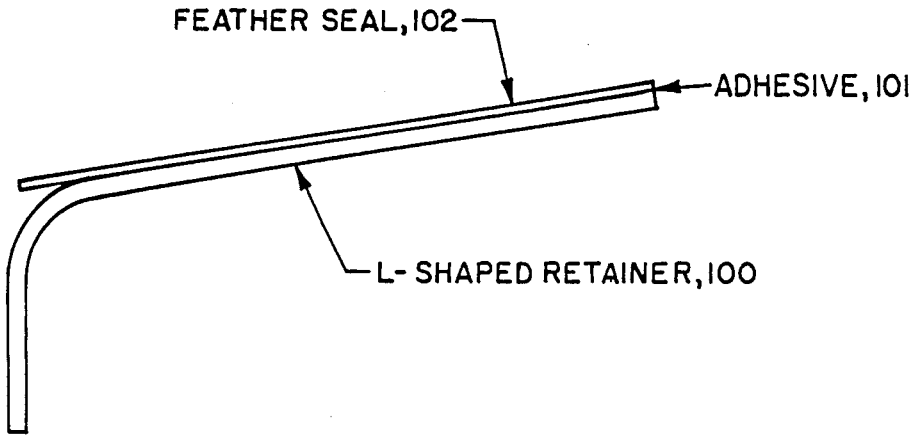
FIG. 2 is an illustration of the present invention.

FIG. 2 is an illustration of the present invention which is intended to replace the existing feather seal 10, which is depicted in FIG. 1 and currently used in turbine engines. The invention is comprised of: an L-shaped retainer plate 100 which is fixed by an adhesive 101 to a thin feather seal 102. The thin feather seal 102 has a thickness of about 0.010 inches, and the retainer plate has a thickness of about 0.020 inches. The combined thickness of the retainer plate, seal, and adhesive is about 0.032 inches, the same as the thickness of the prior art feather seal. While the combined thickness of the present invention equals that of the existing feather seals, the use of the thinner feather seal 102 is more compliant, and provides a more effective air seal to prevent cooling air from entering into the second stage engine flow path.

Figure 3:
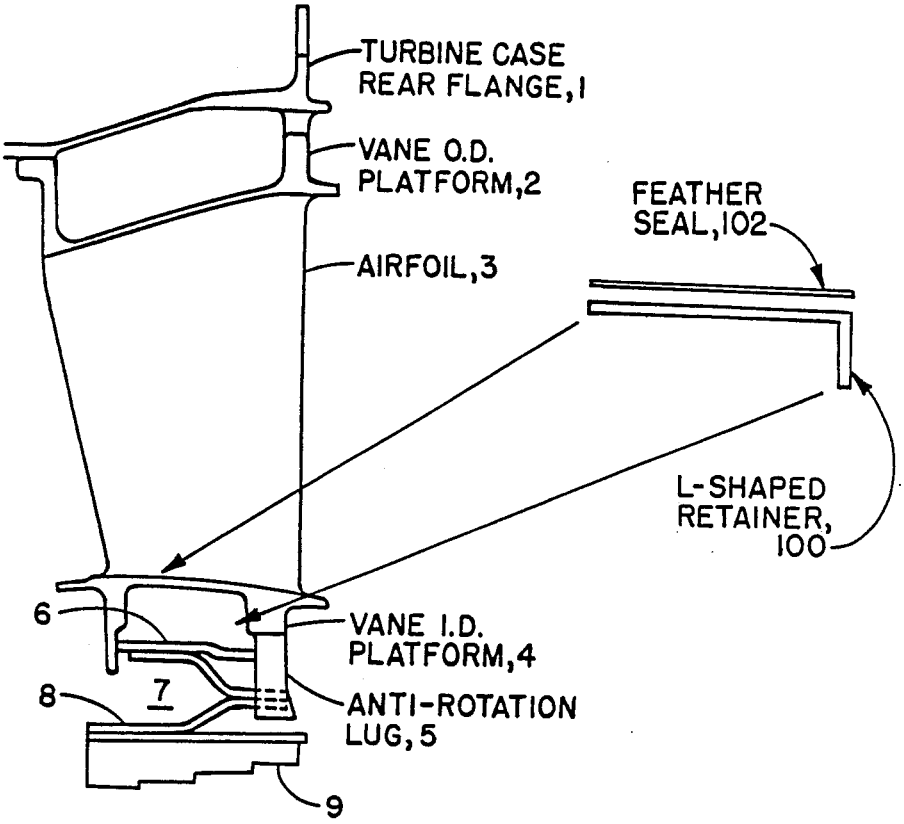
FIG. 3 is a mechanical schematic depicting the substitution of the present invention into the F-100 turbine engine.

FIG. 3 is a mechanical schematic depicting the substitution of the present invention into the F-100 turbine engine in place of the prior art seal of FIG. 1. The seal 102 may be composed of either the same material as the thicker L-shaped seal formerly used, or any of the temperature-resistant materials depicted in the referenced disclosures. The L-shaped retainer plate 100 is metal, and the adhesive 101 coats the contacting surfaces between the retainer plate 100 and the seal 102.

Figure 4:
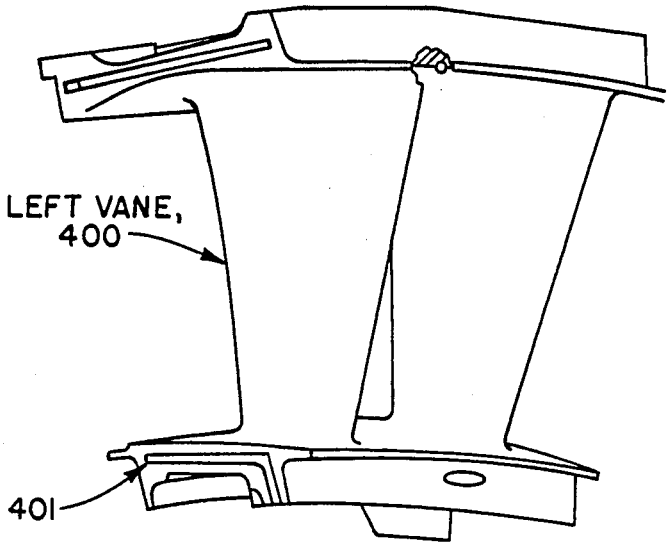
Figure 5:
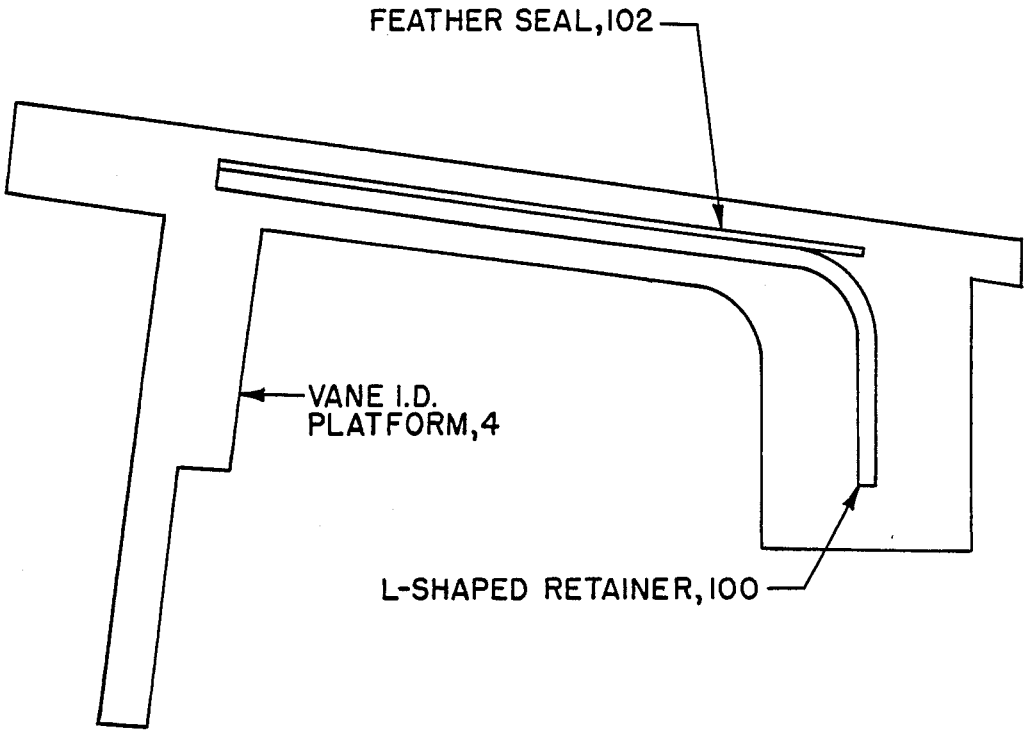
FIG. 5 is a detailed illustration of the vane I.D. platform of FIG. 3 with the feather seal of FIG. 2 installed into machined slots.

FIG. 4 is an end view of the turbine vane assembly of the F-100 turbine engine. In FIG. 4, beneath the left vane 400 is a clear view of the L-shaped slot 401 that the present invention will fit into. Note that the present invention fits in the L-shaped slot in a first vane I.D. platform, and spans to a similar slot in an adjacent vane I.D. platform. FIG. 5 is a detailed view of the vane I.D. platform of FIG. 3, with the feather seal of FIG. 2 installed into machined slots. The adhesive depicted in FIG. 3 is only used for initial assembly purposes. This adhesive is ineffective at turbine operating temperatures and the machined slots of the vane I.D. platform 4 holds the feather seal 102 in place against the L-shaped retainer 100. Note that this seal and retainer extends out of the vane I.D. platform to bridge the gap between adjusted vanes. By entering a similar slot on vane and platforms, the retainer portion 100 gangs adjacent platforms together. Without the use of a retainer, burn through of two adjacent vanes would be sufficient to allow the unseating of a platform. When the retainers are used, it is virtually impossible for platforms to unseat during normal engine operation.

While the invention has been described in its presently preferred embodiment it is understood that the words which have been used are words of description rather than words of limitation and that changes within the purview of the appended claims may be made without departing from the scope and spirit of the invention in its broader aspects.

What is claimed is:

1. In a turbine engine having a combustor with: a turbine case, a flange connected to said turbine case, an outer vane platform connected to said flange, an airfoil connected to said outer vane platform, an inner vane platform connected to said airfoil, and an inner vane suport assembly connected to said inner vane platform, a vane platform feather seal which is fixed in an L-shaped slot in said inner vane platform near said inner vane support assembly to retain said inner vane platform if said airfoil is burned through by a hot streak in said combustor, said vane platform feather seal comprising:

an L-shaped metal retainer which is fixed between said inner vane platform and said inner vane support assembly;

an adhesive which coats a top surface of said L-shaped metal retainer; and a flat seal which is fixed by said adhesive to the top surface of said L-shaped metal retainer.

2. A vane platform feather seal, as defined in claim 1, wherein said L-shaped metal retainer comprises an L-shaped metal plate which has a thickness of about 0.020 inches.

3. A vane platform feather seal, as defined in claim 2, wherein said flat seal has a thickness of about 0.010 inches.

4. A vane platform feather seal, as defined in claim 3, wherein said L-shaped metal retainer, said adhesive, and said flat seal produce a combined thickness of 0.032 inches, which allows said vane platform feather seal to be substituted for vane platform feather seals otherwise used in F-100 turbine engines.

* * * * *